United States Patent [19]

Arai

[11] 4,306,843

[45] Dec. 22, 1981

[54] ELECTROMAGNETIC PUMPS

[75] Inventor: Takatoshi Arai, Yoshimi, Japan

[73] Assignee: Jidosha Kiki Co., Ltd., Tokyo, Japan

[21] Appl. No.: 50,897

[22] Filed: Jun. 21, 1979

[30] Foreign Application Priority Data

Feb. 19, 1979 [JP] Japan ..... 54-20002

[51] Int. Cl.[3] ..... F04B 17/04

[52] U.S. Cl. ..... 417/417

[58] Field of Search ..... 417/417, 415, 416, 552, 417/553, 554; 92/171

[56] References Cited

U.S. PATENT DOCUMENTS

| | | | |
|---|---|---|---|
| 2,155,180 | 4/1939 | Caldwell | 92/171 |
| 2,629,538 | 2/1953 | Reployle | 417/416 |
| 3,400,663 | 9/1968 | Wertheimer | 417/417 |
| 4,047,852 | 9/1977 | O'Connor | 417/415 |

*Primary Examiner*—William L. Freeh
*Assistant Examiner*—Edward Look
*Attorney, Agent, or Firm*—Townsend & Townsend

[57] ABSTRACT

In an electromagnetic pump wherein a sleeve containing a reciprocating pump is clamped between inlet and outlet fixtures, a cylindrical rubber ring is mounted about the sleeve and compressed by the inlet and outlet fixtures to come into intimate contact against the sleeve thus forming a seal.

5 Claims, 3 Drawing Figures

ELECTROMAGNETIC PUMPS

BACKGROUND OF THE INVENTION

This invention relates to an electromagnetic pump of the type utilized to feed fuel to an engine of a motor car.

As disclosed in U.S. Pat. No. 3,400,663 the electromagnetic pump of this type comprises a U shaped housing member, a cylindrical bobbin wound with an exciting coil and disposed in a space in the housing member, a cylindrical nonmagnetic sleeve disposed in the central opening of the bobbin and slidably containing a magnetic plunger, inlet and outlet fixtures threaded to the housing member for holding the opposite ends of the sleeve and a return spring contained by the sleeve for applying return bias to the plunger. The magnetic flux created by pulsating current flowing through the exciting coil cooperates with the return spring to reciprocate the plunger so as to pump liquid from an inlet passage in the inlet fixture to a discharge passage of the outlet fixture through an inlet valve and an outlet valve.

The opposite ends of the sleeve of this pump are fitted in cylindrical portions of the inlet and outlet fixtures respectively. Leakage of the liquid through the joints between the sleeve and the inlet and outlet fixtures is prevented by soldering the outer surface of the sleeve to the end of the outlet fixture and by providing an O-ring in an annular groove on the inner surface of the cylindrical portion of the inlet fixture for sealing the contacting surfaces of the inlet fixture and the sleeve member.

With this construction, however, in order to make uniform the clamping force of the O-ring against the sleeve it is necessary to precisely machine the annular groove.

Moreover, soldering of the outlet fixture and the sleeve is troublesome and if they become eccentric during the soldering operation or if they are secured together in a bent state, the sleeve will be deforemd by the inlet fixture when they are incorporated into the housing member thus making it impossible to assure smooth motion of the plunger. This also renders nonuniform the clamping force of the O-ring which prevents the establishment of a good seat.

When threading the inlet and outlet fixtures into the housing member, if the screw threads of the inlet and outlet fixtures are not in correct coaxial relationship the inlet and outlet fixtures will be secured noncoaxially thus causing deformation of the sleeve and impaired movement of the plunger.

Accordingly, in such prior art electromagnetic pumps it is necessary to machine the component parts to high accuracies. In addition, assembling of the component parts is troublesome, thus increasing the cost.

SUMMARY OF THE INVENTION

Accordingly, it is an object of this invention to provide an improved electromagnetic pump wherein the machining and the assembling of the component parts can be readily achieved.

Another object of this invention is to provide an electromagnetic pump wherein even when the inlet and outlet fixtures are not coaxial, the sleeve will not be deformed so that the plunger contained in the sleeve can reciprocate smoothly.

Still another object of this invention is to provide a low cost electromagnetic pump whose performance will not be affected even when the machining accuracy of the component parts is less than the prior art practice.

According to this invention, there is provided an electromagnetic pump comprising a nonmagnetic sleeve containing a plunger, a cylindrical rubber ring disposed about the sleeve, and an inlet fixture and an outlet fixture respectively including cylindrical members for holding the opposite ends of the sleeve, and means provided for the inlet and outlet fixtures for compressing the rubber ring thereby sealing the joints between the sleeve and the inlet and outlet fixtures.

BRIEF DESCRIPTION OF THE DRAWINGS

In the accompanying drawings

DESCRIPTION OF THE PREFERRED EMBODIMENT

Figure 1:
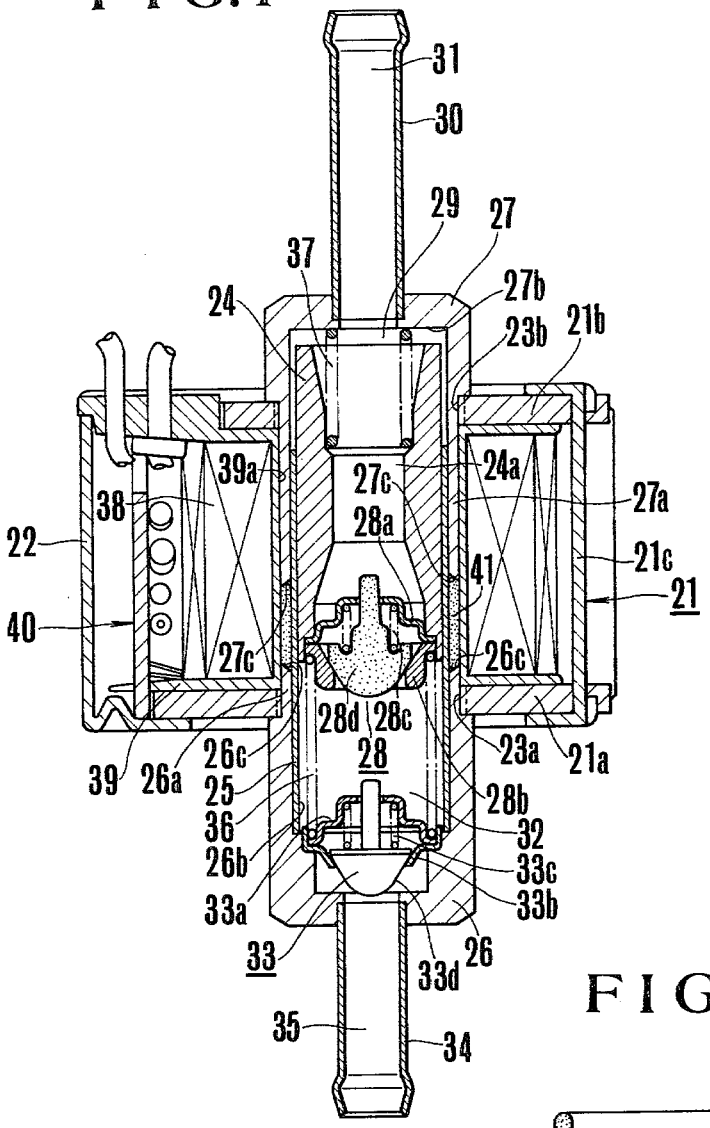
FIG. 1 is a longitudinal sectional view of an electromagnetic pump embodying the invention.
Figure 2:
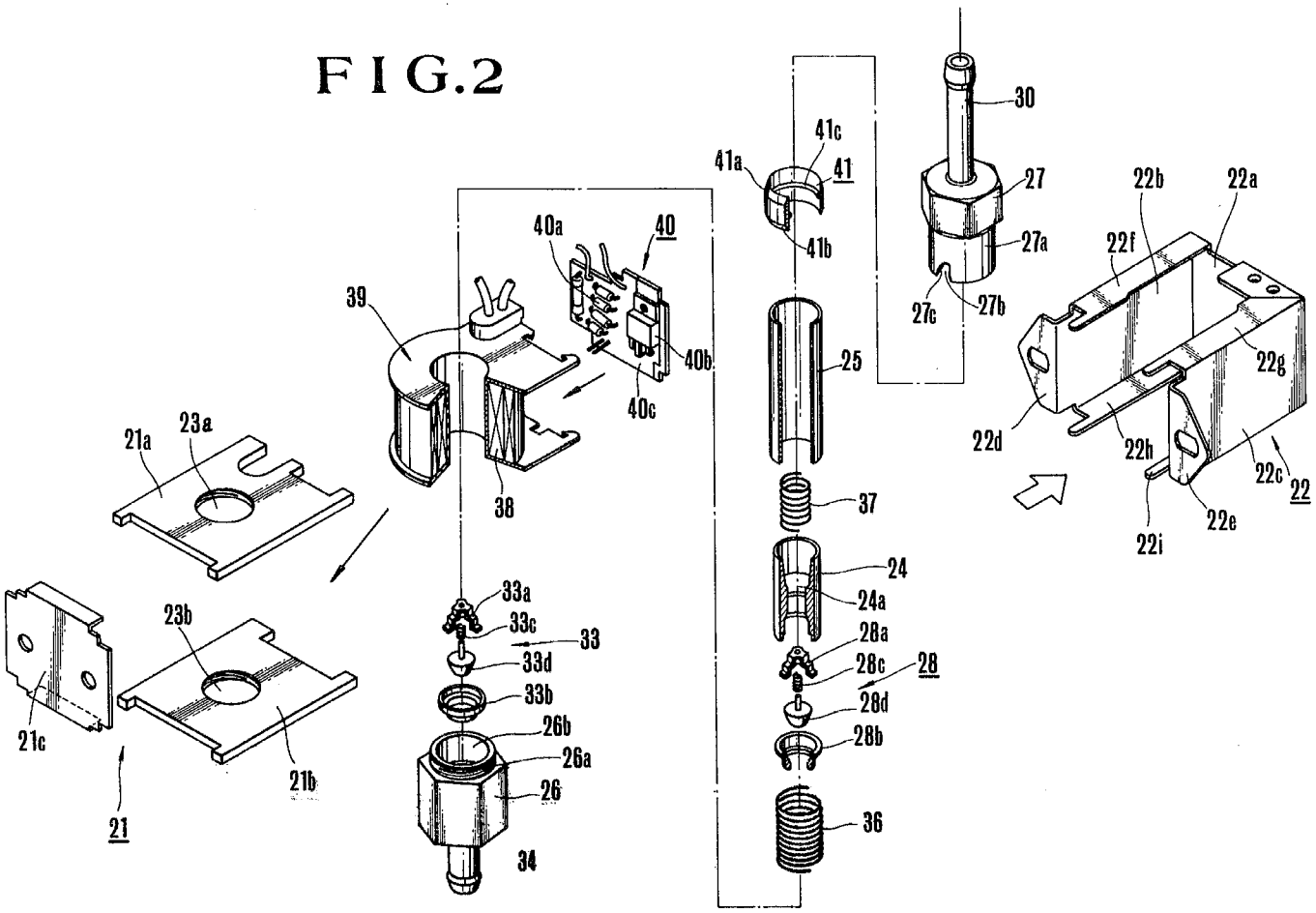
FIG. 2 is an exploded perspective view showing various component parts of the electromagnetic pump shown in FIG. 1.

A preferred embodiment of the electromagnetic pump shown in FIGS. 1 and 2 comprises a generally U shaped yoke number 21 made up of two plate shaped legs 21*a* and 21*b* and a connecting plate 21*c* interconnecting one end of the legs, and a U shaped housing member 22 which is combined with the yoke member 21 to form the vessel of the pump. The space defined by the yoke member 21 and the housing member 22 is used to accommodate the principal component elements of the pump. In this example, the housing member 22 comprises a bottom plate 22*a*, and a pair of side plates 22*b* and 22*c* having outwardly bent flanges 22*d* and 22*e* respectively utilized to mount the electromagnetic pump on the frame of a motor car for example, and inwardly projecting tabs, 22*f*, 22*g*, 22*h* and 22*i*. The yoke member 21 forms a flux path for moving a plunger, the movable portion of the pump as will be described later, and parallel spaced legs 21*a* and 21*b* of the yoke member constitute a supporting frame for supporting various component elements of the pump. The legs 21*a* and 21*b* are formed with coaxial circular openings of the same diameter at their centers. The inner surface of each opening is provided with screw threads.

As above described the space defined by the yoke 21 and the housing member 22 accommodates principal component parts of the pump of the well known construction. More particularly, a nonmagnetic sleeve 25 containing a plunger 24 extends through the openings 23*a* and 23*b* of the legs 21*a* and 21*b* and is positioned with respect to the legs 21*a* and 21*b* by cylindrical portions 26*a* and 27*a* of the inlet and outlet fixtures 26 and 27. Thus, the sleeve 25 is held in the inlet and outlet fixtures 26 and 27 under these conditions. A discharge valve 28 is located beneath the plunger 24 contained in the sleeve 25. The discharge valve 28 comprises a valve body 28*d* held by holders 28*a* and 28*b* and normally biased by a spring 28*c* to close the through bore 24*a* of the plunger 24. The through bore 24*a*, the sleeve 25 and the opening 27*b* of the outlet fixture 27 define a discharge chamber 29 communicated with an outlet passage 30 of a pipe 30 connected to the outlet fixture 27. Inside of the cylindrical portion 26*a* of the inlet fixture 26 is a suction valve 33 which defines a pump chamber 32 between the discharge valve 28 and the suction valve 33. The suction valve 33 is positioned to oppose an inlet passage 35 in a pipe 34 secured to the inlet fixture 26. The suction valve 33 comprises holders 33*a* and 33*b* and a valve body 33*d* held by holders 33*d* and 33*b* and normally urged by a spring 33*c* to close the inlet passage of the inlet fixture 26. A return spring 36 is disposed in the sleeve 25 at a position beneath the plunger 24 so as to normally bias the plunger 24 toward the outlet fixture 27. A spring 37 is provided to absorb shock applied to the outlet fixture 27 by the plunger 24 a bobbin 39 wound with an exciting coil 38 is disposed in the space between the legs 21*a* and 21*b*, and an oscillator 40 constituted by electronic circuit elements 40*a*, a transistor 40*b*, a printed substrate 40*c*, etc. is supported by the upper and lower flanges of the bobbin 39 to pass pulsating current through the exciting coil 38.

Figure 3:
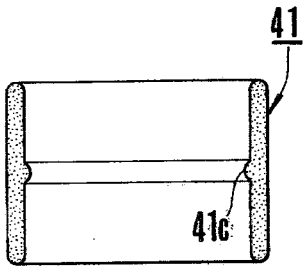
FIG. 3 is a longitudinal sectional view of a rubber ring.

According to this invention, for the purpose of preventing liquid from leaking through the joints between the sleeve 25 and the inlet and outlet fixtures 26, 27 a substantially cylindrical resilient rubber ring 41 as shown in FIGS. 2 and 3 is provided. The opposite ends of the rubber ring 41 are bevelled as at 41*a* and 41*b* and an annular projection 41*c* is formed on the inner surface for holding the sleeve 25. The rubber ring 41 is fitted in a gap defined by the outer surface of the sleeve 25 and the inner surface of the central opening 39*a* of the bobbin 39 and the opposite ends of the rubber ring 41 are compressed by the bevelled surfaces 26*c* and 27*c* at the inner ends of the cylindrical portions 26*a* and 27*a* of the inlet and outlet fixtures 26 and 27. Accordingly, the rubber ring 41 is shaped such that its inner diameter is substantially equal to the outer diameter of the sleeve, the inner diameter of the annular projection is slightly smaller than the outer diameter of the sleeve 25, the outer diameter of the rubber ring 41 is a little smaller than the inner diameter of the central opening 39*a* of the bobbin 39, the axial length is longer than the spacing between the cylindrical portions 26*a* and 27*a* of the inlet and outlet fixtures 26 and 27, and the volume is selected to allow substantial compression deformation or allowance. Thus, the rubber ring 41 is compressed by an amount equal to the allowance by the inner ends of the cylindrical portions 26*a* and 27*a* when the opposite ends of the sleeve member 25 are held by the openings 26*b* and 27*b* of the inlet and outlet fixtures 26 and 27 so that the rubber ring 41 is intimately urged against the outer surface of the sleeve 25 and the inner ends of cylindrical portion 26*a* and 27*a* by the repulsive force thus effectively sealing the joint between them.

Since only the rubber ring 41 is disposed between the opposed cylindrical portions 26*a* and 27*a* it is possible to make the axial length of the rubber ring 41 relatively long. This means that it is possible to make relatively large the initial deformation when the rubber ring 41 is incorporated into the pump and is clamped by the inlet and outlet fixtures 26 and 27. It is known that rubber generally undergoes permanent deformation when it is immersed in gasoline and then subjected to a high temperature while it is being subjected to compression deformation. That is, after subjected to compression deformation it can not restore its original form even when the compression force is removed. When permanent deformation occurs, the repulsion force decreases. Thus, increase in the initial deformation as in this embodiment means less possibility of permanent deformation. Accordingly, even when the parts associated with the rubber ring 41 are not machined precisely, there is no fear of leakage caused by shrinkage of the rubber ring and deformation thereof caused by excessive clamping force thereby forming seals of high reliability.

With the rubber ring of this invention it is not only possible to obtain an optimum compression allowance necessary to assure the sealing effect, but also the relatively long inner surface of the rubber ring firmly holds the sleeve 25 so that the holding force per unit area can be reduced thus preventing local concentrated force. This prevents the establishment of excessive force that would deform the sleeve 25, whereby the entire inner surface of the rubber ring is caused to intimately contact the outer surface of the sleeve 25, thus securely holding the same. In other words, when the rubber ring 41 is correctly positioned about the periphery of the sleeve, the sleeve can be held in a correct position. Considering this fact, in this embodiment, the sleeve 25 is made relatively short as shown in FIG. 2 and the sleeve 25 is located closer to the inlet fixture 26 so as to correspondingly increase the volume of the discharge chamber 29 formed above the plunger 24. This decreases the pulsation of the liquid discharged from the pump thus assuring stable pump action. Of course, the pump is constructed such that the sleeve 25 will not move in the axial direction when the plunger 24 is reciprocated.

As above described, the annular projection 42 formed on the inner periphery of the rubber ring 41 acts to temporarily hold the short sleeve 25 when it is assembled, and when a compressive force is applied to the rubber ring 41 the annular projection 42 is flattened to increase its intimate contacting ability as well as sealing ability. In this embodiment, beveled surfaces 26*c* and 27*c* are formed on the inner ends of the cylindrical portions 26*a* and 27*a* of the inlet and outlet fixtures so as to urge the rubber ring 41 against the outer surface of the sleeve member 25 to improve sealing ability.

The electromagnetic pump described above can be readily assembled in the following manner. Bobbin 39, oscillator 40, etc. are clamped between a pair of plate shaped legs 21*a* and 21*b* of the yoke and the outlet fixture 27 is threaded into one leg 21*a*. The sleeve 25 is fitted with the rubber ring 41, plunger 24 inserted is with the discharge valve 23, the return spring 31 and the suction valve 33 are successively inserted through the opening 23*b* of the other leg 21*b* towards inner end 27*b* of the outlet fixture 27. Then the inlet fixture 26 is threaded into the opening 23*b* of the leg 21*b*. Before pressure is applied to rubber ring 41 by mounting the inlet fixture 26 the rubber ring 41 does not intimately contact the sleeve 25 so that its sleeve holding force is small, but the annular projection 42 provides the necessary sleeve holding force. This prevents axial movement of the sleeve 25 at the time of assembly thus simplifying the assembly operation. It should be understood that the order of assembly is not limited to the order described above. The connecting plate 21*c* is then combined with legs 21*a*, 21*b* which are incorporated with various component elements and then the yoke member 21 is inserted into the housing member 22 to complete the electromagnetic pump as shown in FIGS. 1 and 2.

In the electromagnetic pump thus assembled, the opposite ends of the sleeve 25 are received in the openings of the inlet and outlet fixtures 26 and 27 and the rubber ring 41 mounted about the sleeve 25 is compressed from the opposite ends by the inner ends of the cylindrical portions 26*a* and 27*a* of the inlet and outlet fixtures 26 and 27 and urged against the outer surface o the sleeve 25 along the bevelled surfaces 26*c* and 27*c*. Consequently, the inner surface of the rubber ring 41 is firmly pressed against the outer surface of the sleeve 25 thus perfectly sealing the contact surface. The opposite ends of the rubber ring are caused to intimately contact against the inner ends of the cylindrical portions 26*a* and 27*a* of the inlet and outlet fixtures 26 and 27 thus forming a perfect seal. As above described the joints between the sleeve 25 and the inlet and outlet fixtures 26 and 27 are perfectly sealed so that when the axes of the fixtures 26 and 27 and the axis of the sleeve 25 are offset more or less at the time of assembly, the sealing property will not be affected. Moreover, as the sleeve 25 is not deformed, the plunger can reciprocate smoothly.

Although in the foregoing embodiment, a single annular projection 42 was provided on the inner surface of the rubber ring 41 for holding the sleeve member 25 during assembly such projection may be omitted. Further, the projection may take many other forms than annular. In addition, although the inner ends of the cylindrical portions 26*a* and 27*a* of the inlet and outlet fixtures 26 and 27 were bevelled for compressing the rubber ring 41 any other means may be substituted for the bevelled surfaces 26*c* and 27*c*.

In the illustrated example, the pump container is constituted by a yoke member 21 including three plates and a housing member 22, an oscillator 40 including a transistor and a printed substrate are contained in the pump and discharge valve 28 is located beneath the plunger 24 it should be understood that the invention is also applicable to an electromagnetic pump having other construction.

According to this invention, since a single rubber cylinder is used at the joints between the sleeve and the inlet and outlet fixtures it is possible to readily and accurately seal the joints with simple construction thus simplifying assembly.

The rubber ring of this invention has a relatively long axial length and an optimum deformation allowance with the result that the variation in the repulsive force caused by such deformation does not affect the seal. This means that the sealing ability is not damaged by the variation in external conditions and that component parts of the pump are not required to have accurate dimensions thus simplifying machining. The dimensional accuracies of various parts that determine the length of the rubber ring after mounting are not required to be so precise. The rubber ring of this invention can hold positively without radially deforming the sleeve and can limit the axial movement thereof thus always maintaining a highly reliable seal.

What is claimed is:

1. An electromagnetic pump comprising:

a non magnetic sleeve containing a plunger;

electromagnetic means for reciprocating said plunger in said sleeve;

a resilient deformable cylindrical ring disposed on the outer surface of said sleeve, the inner diameter of said ring being substantially equal to the outer diameter of said sleeve, said ring including a projection on its inner surface for holding said sleeve;

an inlet fixture having a cylindrical portion for axially receiving one end of said sleeve, inlet valve means coupled to said inlet fixture;

an outlet fixture having a cylindrical portion for axially receiving the other end of said sleeve; and outlet valve means coupled to said outlet fixture, said inlet fixture and said outlet fixture including means for axially compressing said cylindrical ring on the outer surface of said sleeve through both ends of said cylindrical portions of said inlet and said outlet fixtures, thereby sealing the joint between said sleeve and said inlet and outlet fixtures.

2. The invention according to claim 1 wherein said projection is annular.

3. The invention of claim 1 wherein the ends of said cylindrical portions of said inlet and said outlet fixture are beveled to improve the sealing function of said ring.

4. The invention of claim 1 wherein the ends of said ring are beveled to improve the sealing function of said ring.

5. The invention of claim 1 wherein the ends of said cylindrical portions of said inlet and said outlet fixtures are spaced by a predetermined distance, and wherein the axial length of said ring in the relaxed state is greater than said predetermined distance.

* * * * *